US005553475A

United States Patent [19]

Hayashi et al.

[11] Patent Number: 5,553,475

[45] Date of Patent: Sep. 10, 1996

[54] METHOD FOR DETECTING SETTING ERRORS OF CLEARANCE BETWEEN ROLLERS IN UNIVERSAL ROLLING MILL, AND METHOD FOR ROLLING H-SHAPED STEEL HAVING FAVORABLE FLANGE DIMENSIONS UTILIZING SAME DETECTING METHOD

[75] Inventors: Hiroyuki Hayashi; Takaaki Iguchi, both of Chiba; Shinji Inamura, Kurashiki, all of Japan

[73] Assignee: Kawasaki Steel Corporation, Kobe, Japan

[21] Appl. No.: 307,747

[22] PCT Filed: Mar. 26, 1993

[86] PCT No.: PCT/JP93/00369

§ 371 Date; Sep. 21, 1994

§ 102(e) Date: Sep. 21, 1994

[87] PCT Pub. No.: WO93/19861

PCT Pub. Date: Oct. 14, 1993

[30] Foreign Application Priority Data

Mar. 27, 1992 [JP] Japan ..... 4-071308
Apr. 7, 1992 [JP] Japan ..... 4-085555

[51] Int. Cl.[6] ..... B21B 1/08; B21B 37/12

[52] U.S. Cl. ..... 72/225; 72/8.9; 72/16

[58] Field of Search ..... 72/8, 6, 19, 19, 72/225

[56] References Cited

U.S. PATENT DOCUMENTS 4,512,169 4/1985 Miura ..... 72/16
4,958,509 9/1990 Kusaba et al. ..... 72/225
5,009,094 4/1991 Hayashi et al. ..... 72/225
5,203,193 4/1993 Iguchi et al. ..... 72/225

FOREIGN PATENT DOCUMENTS 53-48067 5/1978 Japan .
58-51768 11/1983 Japan .
59-8445 2/1984 Japan .
59-16525 4/1984 Japan .
62-263801 11/1987 Japan .
63-123510 5/1988 Japan .
3-24301 3/1991 Japan .
3-23241 3/1991 Japan .
5-107047 4/1993 Japan .

*Primary Examiner*—W. Donald Bray
*Attorney, Agent, or Firm*—Dvorak and Traub

[57] ABSTRACT

According to the present invention, in the rolling of an H-shaped steel wherein a roughly shaped billet subjected to a breakdown rolling and having a web and flanges is formed into a shape steel having H-shaped cross section by passing it through an array of rolling facilities for a shape steel constituted by combining a universal rough rolling mill with a universal finish rolling mill, a thickness of each flange at four locations, i.e. right and left upper and lower locations, of the roughly shaped billet are measured by an instrument for measuring hot dimensions, which is arranged in the vicinity of the rough universal rolling mill, and then, based on the results of the measurement, there are attained an axial deviation of upper and lower horizontal rollers relative to each other, a deviation of apertures of left and right vertical rollers with respect to each other, and a deviation of the center position of a clearance between the upper and lower horizontal rollers with respect to the central position of the vertical roller barrels.

3 Claims, 11 Drawing Sheets

METHOD FOR DETECTING SETTING ERRORS OF CLEARANCE BETWEEN ROLLERS IN UNIVERSAL ROLLING MILL, AND METHOD FOR ROLLING H-SHAPED STEEL HAVING FAVORABLE FLANGE DIMENSIONS UTILIZING SAME DETECTING METHOD

BACKGROUND OF THE INVENTION

The present invention relates to a method for producing an H-shaped steel having a good dimensional accuracy by hot rolling employing a universal rolling mill.

BACKGROUND ART

Facilities for hot rolling an H-shaped steel comprise a breakdown rolling mill 1, a universal rough rolling mill 2, an edger rolling mill 3, and a universal finish rolling mill 4 as shown in FIGS. 1(*a*) and 1(*b*). In the facilities, raw materials such as slab 5, bloom 6, or beam blank 7 shown in FIG. 2 are successively rolled by the above-described mills to form an H-shaped steel having a predetermined sectional dimension.

In the above-mentioned facilities, the breakdown rolling mill 1 is a two high mill having upper and lower rollers provided with, along a roller barrel, a plurality of open passes 8 or closed passes 9 shown in FIG. 3. In this mill, there is formed a roughly H-shaped billet.

In the universal rough rolling mill having horizontal rollers and vertical rollers, the web w of the billet is reduced by the horizontal rollers 10*a* and 10*b* in the thickness-wise direction, and the flanges f of the billet are reduced by the horizontal rollers 10*a* and 10*b*, and the vertical rollers 11*a* and 11*b* in the thickness-wise direction, respectively as shown in FIG. 4(*a*). With respect to the widths of flanges, they are reduced by the rolling mill having edger rollers 12*a* and 12*b* as shown in FIG. 4(*b*).

At this stage, the billet obtained by the breakdown rolling is usually rolled over a plural times, and then, it is finished as a final product by the universal finish rolling mill as shown in FIG. 4(*c*).

In a rolling of the H-shaped steel conducted in a procedure such as above, there is used a rolling mill having horizontal rollers functioning as an upper roller and a lower roller constituting a pair, and vertical rollers functioning as a right roller and a left roller constituting a pair. When a rolling of a material is conducted, a rolling reaction is exerted to each one of the rollers, thereby elastically deforming them. As a result, clearances between the rollers become larger during the operation when compared with the clearances with no load. When the web and flanges are reduced at an usual draft, the thickness of each part after rolling is equal to the dimension of the clearance between the rollers which have rolled the part. Accordingly, if the clearance between the rollers during the rolling is at an inappropriate value, there may be a case where the thickness after the pass differs from an aimed value. Particularly, since there are conducted plural passes of rolling in the usual universal rough rolling, the dimensional fluctuation in a certain pass results in an external disturbance to the-next pass, which functions as a factor inviting the degraded dimensional accuracy of the final product.

Furthermore, demands for thin H-shaped steel have been increasing in the recent years. In the production of these thin H-shaped steels, flange portions which have a cooling rate smaller than that of the web portion are sometimes forcibly cooled by water in the process of hot rolling or after the completion of the final product from the viewpoint of reducing the residual stress or of preventing shape defects. In this occasion, if the thicknesses of the flanges in right and left upper and lower parts are uneven, the temperature of each parts of the steel cannot be uniform. This unevenness of cooling may give rise to shape defects in the resulting product.

Various methods have been studied with respect to a control of clearance between the rollers in the course of rolling. As a typical method, there is so-called set up control. In this method, it is intended to adjust the clearance between the rollers beforehand, namely when no load is applied thereto, by estimating the rolling reaction (rolling load) by means of the linear relationship between the rolling reaction and the increment of clearance between the rollers. As documents regarding this respect, it can be referred to JP-A-63-104714 and JP-A-63-123510, which respectively disclose a technique wherein thicknesses of flanges and web are controlled by adjusting clearances between horizontal rollers and vertical rollers in a universal rolling mill.

Now, in the actual process of universal rolling of H-shaped steel, the reason why fluctuation of the clearances between the rollers occurs is not limited to the rolling reaction of rollers. It also occurs due to deficiency in set-up accuracy of the clearance between the rollers or mechanical looseness. Since these factors significantly affect the dimensional accuracy of the H-shaped steel, it has been the present status that the flange thicknesses in right and left upper and lower parts of the H-shaped steel cannot be made equal by simply applying the prior art described above.

In particular, the relative errors (thrust amounts), in the axial direction, between the upper and lower horizontal rollers arranged in the universal rolling mill significantly affect the dimensional accuracy. The mechanism is as follows. In the universal rolling of the H-shaped steel, the flanges are reduced in the thickness-wise direction between the end surfaces of the horizontal rollers 10*a* and 10*b* and the vertical rollers 11*a* and 11*b* as shown in FIG. 5. Here, if the horizontal roller(s) are shifted in the axial direction as shown in FIG. 6 or FIG. 7, the clearance between rollers on one side increases, while the clearance on the other side decreases correspondingly, because the widths of the horizontal rollers are constant. As a result, the thicknesses of the flanges of the H-shaped steel change in the right and left upper and lower portions. Also, since the end surfaces of the horizontal rollers of the universal rough rolling mill are inclined, the thicknesses of the flanges also fluctuate in the case where the positions of the upper and lower horizontal rollers deviate relative to the vertical rollers as shown in FIG. 8.

Such fluctuation of flange thickness leads to a difference in the draft of each flanges, and further to a difference in the length of flange foot (a dimension from the web to the end of the flange in the widthwise direction) thereof, thereby causing misalignment of a center of the flange f in the widthwise direction with that of the web w in the thickness-wise direction, namely "deviation of center," as shown in FIGS. 9(*a*) and 9(*b*).

In this connection, according to JIS G 3192, the tolerance of this "deviation of center" (hereinafter referred to simply as "center deviation") is defined as ±2.5 mm if the height of web is 300 mm or less (nominal dimension), and ±3.5 mm if that is over 300 mm.

As the prior art for reducing the above-described center deviation, there are many methods mainly proposing to control a gripped state of a material to be rolled in a universal rolling mill. For example, JP-B-3-23241 discloses a method for controlling a gripped angle of a material to be rolled by detecting the deviation of the web of materials to be rolled, and JP-A-53-48067 discloses the method for controlling a gripped level of a material to be rolled.

However, the method disclosed in the above-mentioned JP-B-3-23214 is a method that only guides materials to be rolled into a universal rolling mill, and the extent it can guide the materials to be rolled is within a range where the rolling facilities are never concerned. Since it does not guide the materials to just in front of the gripping position of the rollers, it is difficult to correct the center deviation directly, and therefore, the effect of improvement is extremely little. The method disclosed in the JP-A-53-48067 is similar to the above, hence it was difficult to keep holding materials to be rolled until they reach just in front of the gripping position of the rollers, and thus, the effect of reduction of the center deviation was extremely little. Here, in rolling a H-shaped steel, there also tends to occur such a center deviation that makes the H-shaped steel vertically asymmetrical as shown in FIG. 9(*b*). In such a case, it is necessary to roll the right and left flanges of the material to be rolled in absolutely different postures, but no discussion is made on this aspect in the above-mentioned methods.

It is an object of the present invention to solve the above-mentioned problems inherent in the conventional hot rolling of a H-shaped steel. More particularly, it is an object of the invention to propose a new method capable of making thicknesses of the flanges in right and left upper and lower portions equal, and capable of reducing center deviation as well.

DISCLOSURE OF THE INVENTION

The present invention is designed to grasp the values of the relative error, in the axial direction, between the upper and lower horizontal rollers, the relative error of apertures of left and right vertical rollers with respect to each other, or the relative error of the center of the clearance between the upper and lower horizontal rollers with respect to the central position of the vertical roller barrels, in the case where the measured thickness of each flange of the roughly shaped billet is uneven or, in addition to this, there is unevenness in the measured length of the flange foot, and to correct each clearance between the rollers exactly in accordance with the thus-grasped errors.

In other words, according to the first aspect of the present invention, there is provided a method for detecting setting errors of clearances between rollers in a universal rolling mill characterized in that: when forming a roughly shaped billet after a breakdown rolling having a web and flanges into a shape steel having H-shaped cross section by passing it through an array of rolling facilities for a shape steel constituted by combining a universal rough rolling mill with a universal finish rolling mill, a thickness of each flange at four locations, i.e. right and left upper and lower locations, of the roughly shaped billet are measured by an instrument for measuring hot dimensions arranged in the vicinity of the rough universal rolling mill, and then, based on the results of the measurement, there are obtained an axial deviation of upper and lower horizontal rollers relative to each other, a deviation of apertures of left and right vertical rollers with respect to each other, and a deviation of the center position of a clearance between the upper and lower horizontal rollers with respect to the central position of the vertical roller barrels.

Also, according to the second aspect of the present invention, there is provided a method for forming a roughly shaped billet after a breakdown rolling having a web and flanges into a shape steel having H-shaped cross section by passing the roughly shaped billet through an array of rolling facilities for a shape steel constituted by combining a universal rough rolling mill, which is capable of adjusting axial positions of horizontal rollers at every passes, with a universal finish rolling mill; wherein thickness of each flange at four locations, i.e. right and left upper and lower locations, of the roughly shaped billet are measured by an instrument for measuring hot dimensions arranged in the vicinity of the rough universal rolling mill, during the rolling of the roughly shaped billet; basing on the results of the measurement, there are calculated amounts of an axial deviation of upper and lower horizontal rollers relative to each other, a deviation of apertures of left and right vertical rollers with respect to each other, and a deviation of the center position of a clearance between the upper and lower horizontal rollers with respect to the central position of the vertical roller barrels; the position of each roller is adjusted so that these deviations are corrected to zero or to an allowable value; and one or more passes of rolling are conducted on the roughly shaped billet after the adjustment.

Further, according to the third aspect of the present invention, there is provided a method for forming a roughly shaped billet after a breakdown rolling having a web and flanges into a shape steel having H-shaped cross section by passing the roughly shaped billet through an array of rolling facilities for a shape steel constituted by combining a universal rough rolling mill, which is capable of adjusting axial positions of horizontal rollers at every passes, with a universal finish rolling mill; wherein thickness of each flange at four locations, i.e. right and left upper and lower locations, of the roughly shaped billet as well as foot length of each flange are measured by an instrument for measuring hot dimensions arranged in the vicinity of the rough universal rolling mill, during the rolling of the roughly shaped billet; center deviation amounts of the right and left flanges are calculated, thus obtaining a target outlet thickness of each flange for the next pass, that would have reduced the above-calculated center deviations to zero or to an allowable value, by taking account of a preobtained relationship between a rolling draft difference between the upper and lower flanges and a varied amount of center deviation, an aimed rolling draft of the flanges in the next pass, and the condition that averages of rolling drafts for upper and lower flanges on right and left sides should be equal; there are calculated amounts of an axial deviation of upper and lower horizontal rollers relative to each other, a deviation of apertures of left and right vertical rollers with respect to each other, and a deviation of the center position of a clearance between the upper and lower horizontal rollers with respect to the central position of the vertical roller barrels basing on the above-obtained target outlet flange thicknesses; the position of each roller is adjusted on the basis of the thus-attained deviations; and one or more passes of rolling are conducted on the roughly shaped billet after the adjustment.

Hereinafter, there will be described a method comprising steps of obtaining an amount of deviation of each rollers (hereinafter referred to simply as "deviation amount") by measuring thickness of each flange at four locations in a roughly shaped billet, with or without the foot length thereof, and modifying the deviation amounts.

In a hot rolling of an H-shaped steel, it is possible to apply a known technique (see Japanese Patent Application No.

3-293582) for measuring a thickness of each flange at right and left upper and lower locations of a roughly shaped billet, as well as a foot length of each flange. It is sufficient that such measurement is made at one location in the longitudinal direction of the roughly shaped billet, however, if it is made at plural locations, an average of measured data for each of right and left upper and lower flanges (except for data of the longitudinal end region of the billet) can be used as a value representing the thickness and foot length of each flange.

In a roughly shaped billet having been subjected to a breakdown rolling (hereinafter referred to as a material to be rolled), an upper flange on an operating side (OP side) of a rolling mill, a lower flange on the operating side (OP side), an upper flange on a driving side (DR side) of the rolling mill, and a lower flange on the driving side (DR side), are distinguished from each other by accompanying lower subscripts, 1, 2, 3, and 4, respectively, and also, the OP side and DR side are distinguished from each other by lower subscripts of OP and DR. Furthermore, although an end (lateral) surface of the horizontal roller has an inclination angle θ in the actual rough universal rolling mill, a thickness between the lateral surface of the horizontal roller and the barrel surface of the vertical roller taken in the orthogonal direction with respect to the shaft of a vertical roller is used, for simplicity, as the thickness of a flange formed therebetween. On the above condition, the present invention will be concretely described below.

Defining $t_f$ as a measured value of a thickness of a flange after the completion of the i th pass, and t as a value obtained by converting the measured value into a thickness in the orthogonal direction with respect to the shaft of a vertical roller by neglecting the inclination angle θ of a horizontal roller, t is expressed as follows:

$$t=t_f/\cos\theta \tag{1}$$

In addition, T is defined as a target thickness of the flange for the next pass, and this also means, in the following description, a thickness between an end surface of the horizontal roller and the vertical roller taken in the orthogonal direction with respect to the shaft of a vertical roller.

THE FIRST ASPECT OF THE INVENTION

Since a clearance between rollers at the time of rolling and a thickness of a rolled material coming out therefrom are equal, a measured value of thickness of each flange at four locations of right and left upper and lower in the rolled material can be regarded as a thickness of the corresponding clearance which is defined by the horizontal rollers and the vertical rollers.

Here, defining ΔT as a deviation amount of the upper horizontal roller in the axial direction of roller shaft, taking the position of the lower horizontal roller as a basis, ΔV as a deviation amount of the vertical roller on driving side (DR side), taking the position of the vertical roller on the operating side (OP side) as a basis, and ΔH as a deviation amount of the center position of the clearance between the upper and lower horizontal rollers with respect to the central position of the roller barrel of the vertical roller; their relationship would be illustrated as in FIG. 10.

Also, when $t_0$ is defined as a thickness of a flange at a time when there are no setting errors for roller positions, namely at a time when ΔT=0, ΔV=0, and ΔH=0, and ΔC is defined as a deviation amount of a vertical roller caused by ΔH, the following formulae are derived from the relationship shown in FIG. 10:

$$t_1=t_0+\Delta T+\Delta C \tag{2}$$

$$t_2=t_0-\Delta C \tag{3}$$

$$t_3=t_0-\Delta T+\Delta V+\Delta C \tag{4}$$

$$t_4=t_0+\Delta V-\Delta C \tag{5}$$

Therefore, $$t_0=(t_1+3t_2+t_3-t_4)/4 \tag{6}$$

$$\Delta C=(t_1-t_2+t_3-t_4)/4 \tag{7}$$

$$\Delta H=\Delta C/\tan\theta \tag{8}$$

$$\Delta T=\{(t_1-t_2)-(t_3-t_4)\}/2 \tag{9}$$

$$\Delta V=t_4-t_2 \tag{10}$$

That is, if the thicknesses $t_1$, $t_2$, $t_3$, and $t_4$ of the flanges at four locations, i.e. right and left upper and lower locations, of the material to be rolled are measured by an instrument for measuring hot dimensions and each measured value is corrected in accordance with the inclined angle θ of the roller to obtain a size of each clearance between the rollers, deviation amounts of rollers in the universal rolling mill can be attained by using the above formulae (7), (8), (9), and (10).

THE SECOND ASPECT OF THE INVENTION

If there is any deviation between the horizontal rollers and the vertical rollers of the universal rolling mill when a material to be rolled is under the rolling, from the fact that the mechanical looseness is absorbed by the rolling reaction, it is considered that the deviation is mainly caused by a deviation of the roller positions at the zero point (standard position). Therefore, it is feared that the same error (error of the clearance between the rollers) occurs also in the following passes. In order to uniformalize the thicknesses of the flanges at four locations in a material to be rolled, it is necessary to conduct a reduction adjustment (adjustment of each roller position) so that such deviations are negated.

Here, defining $R_H$ as a radius of the horizontal rollers in the universal rolling mill, $R_V$ as a radius of the vertical rollers, M as a plasticity constant of the material to be rolled, $K_H$ as a mill rigidity of the horizontal rollers in the reduction direction, $K_V$ as a mill rigidity of the vertical rollers in the reduction direction, and $K_T$ as a mill rigidity of the horizontal rollers in the axial direction, the deviation amounts of ΔT, ΔV, and ΔC of the rollers at the time of rolling are converted into deviation amounts of $\Delta S_T$, $\Delta S_Y$, and $\Delta S_H$, which are those at the time of no load, by using thicknesses $t_f$ of flanges of upper and lower right and left locations and target thicknesses $T_f$ of those flanges while taking the mill rigidities into account as in the following formulae. In this connection, for the relation formulae $f_1$, $f_2$, $f_3$ and $f_4$ between the modification amounts for deviations of rollers and the deviation amounts of rollers at the time of rolling, those obtained in advance by calculation or actual measurement are used.

$$\Delta S_T=f_1\,(M, K_T, t_f, T_f, R_H, R_V)\cdot\Delta T \tag{11}$$

$$\Delta S_Y=f_2\,(M, K_T, t_f, T_f, R_H, R_V)\cdot\Delta V \tag{12}$$

$$\Delta S_H=f_3\,(M, K_T, t_f, T_f, R_H, R_V)\cdot\Delta H \tag{13}$$

Also, even when there are no errors (deviations) in the setting positions of the rollers, it is conceivable that the thickness $t_0$ of the flanges differs from the target value in the current pass by $\Delta t$. In this case, by the same consideration with the usual thickness control, the difference is converted into a correction amount of $\Delta S_f$ for a space between the vertical rollers at the time of no load, and the clearance between the right and left vertical rollers are corrected accordingly.

$$Sf=f_4\ (M,\ K_T,\ t_f,\ T_f,\ R_H,\ R_V)\cdot\Delta t \tag{14}$$

Now, defining the clearances between rollers (those in which the rolling reaction has already been taken into account) at the time of rolling in the next pass as $S_{VOP}$ and $S_{VDR}$ with respect to the right and left vertical rollers, and as $S_{HU}$ and $S_{HL}$ for the upper and lower horizontal rollers, and also, defining the thrust between the upper and lower horizontal rollers as $S_{HT}$, the clearances between the rollers can be expressed as follows if correcting amounts for deviation of rollers are added to those marked with asterisk "*".

$$S_{VOP}^*=S_{VOP}-\Delta Sf \tag{15}$$

$$S_{VDR}^*=S_{VDR}-\Delta Sf-\lambda\Delta SV \tag{16}$$

$$S_{HU}^*=S_{HU}-\lambda\Delta S_H \tag{17}$$

$$S_{HL}^*=S_{HL}+\lambda\Delta S_H \tag{18}$$

$$S_{HT}^*=S_{HT}-\lambda\Delta S_T \tag{19}$$

In this respect, if adjustments of rollers are conducted in such a way that the reduction modification is completed in the next single pass, there sometimes occur shape defects in the rolled material. Therefore, it is effective to execute the rolling by multiple passes by multiplying a relaxation coefficient $\lambda(0\leqq\lambda\leqq1)$.

Accordingly, it is possible to roll a H-shaped steel having flanges of uniform thickness if the reduction modification (the correction of roller deviations) is conducted in the next pass or in following several passes in accordance with the procedures described above.

THE THIRD ASPECT OF THE INVENTION

If the thickness of each flange at right and left upper and lower locations and the flange foot length d in the material to be rolled are measured by an instrument for measuring hot dimensions in the vicinity of the universal rough rolling mill, the center deviation amounts W can be obtained by the following formulae:

$$W_{OP}=(d_1-d_2)/2 \tag{20}$$

$$W_{DR}=(d_3-d_4)/2 \tag{21}$$

A difference in drafts of the upper and lower flanges due to asymmetry of clearances between the rollers, which is caused by an axial deviation of the rollers may be mentioned as a principal cause of such a center deviation in the universal rolling of an H-shaped steel.

FIG. 11 is a view showing a relationship between draft differences between the upper and lower flanges and varied amounts of the center deviation in the case where clearances formed between the lateral surfaces of the upper and lower horizontal rollers and the barrels of the vertical rollers are changed by axially shifting the horizontal rollers in the universal rolling mill so that they relatively deviates from each other (also, the drafts of the web and flanges are changed variously), during a rolling of an H-shaped steel whose web height is 600 mm and flange width is 300 mm (nominal dimensions).

From FIG. 11, it is clear that the draft difference between the upper and lower flanges and the varied amounts of the center deviation constitute a linear relationship, and with these data, it is possible to determine the inclination of the straight line of this relationship by using the method of least squares. In this connection, if there is no difference between the drafts of the upper and lower flanges, the center deviation is not changed because both upper and lower flanges are rolled under the same condition. Therefore, the relationship between the draft difference between the upper and lower flanges and the varied amount of the center deviation can be represented by a straight line passing through the origin of the coordinates. Defining $\alpha$ as the inclination of this straight line, and r as the draft of the flanges, the varied amount of center deviation $\Delta W$ can be expressed as follows:

$$\Delta W_{OP}=\alpha(r_1-r_2) \tag{22}$$

$$\Delta W_{DR}=\alpha(r_3-r_4) \tag{23}$$

Since the actual measured value W of the center deviation can be obtained from the above-mentioned formulae (20) and (21), the drafts for the upper and lower right and left flanges in the next pass are set so that the $W+\Delta W$ on both OP and DR sides becomes zero or a target value.

Here, there are some cases where a rolling is performed under such conditions that the center deviation is not reduced to zero. This is because of the fact that if the clearances at upper and lower right and left locations between rollers are greatly changed in a rolling of the flanges of a material to be rolled, they sometimes cause shape defects, and in order to avoid this problem, the target value for the center deviation in a certain pass may be made at $\beta(W+\Delta W)$ (where $0\leqq\beta\leqq1$) in some cases.

Next, the description will be made with respect to the way of determining roll clearances (clearances at four locations for the reduction of the flanges), which are defined by the horizontal rollers and the vertical rollers in a rolling mill, on the basis of target draft differences between the upper and lower flanges.

First, $\Delta r_{OP}$ as a target value of the draft difference between the upper and lower flanges on OP side, $\Delta r_{DR}$ as a target value of the draft difference between the upper and lower flanges on DR side, and $r_f$ as an aimed draft of the next pass which is predetermined in accordance with the pass schedule, the relationship between the average flange thickness $t_m$ (current pass) of the four positions and the average flange thickness $T_m$ after the rolling in the next pass is expressed as follows:

$$t_m=(t_1+t_2+t_3+t_4)/4 \tag{24}$$

$$T_m=(T_1+T_2+T_3+T_4)/4 \tag{25}$$

$$T_m=(1-r_f)\cdot t_m \tag{26}$$

Also, in order to set the draft differences between the upper and lower flanges at target values, they should satisfy the following equations respectively on the OP side and DR side:

$$(T_2/t_2)-(T_1/t_1)=\Delta r_{OP} \tag{27}$$

$$(T_4/t_4)-(T_3/t_3)=\Delta r_{DR} \tag{28}$$

In addition, in order to prevent flanges from bending toward right or left during the rolling, it is necessary to balance the draft averages of upper and lower flanges between the right and left sides. Accordingly, $$(T_1/t_1)+(T_2/t_2)=(T_3/t_3)+(T_4/t_4) \quad (29)$$

Therefore, from the formulae (19) to (29), the clearances between the rollers $T_1$, $T_2$, $T_3$, and $T_4$ at four locations in the next pass can be obtained by the following formulae based on actually measured flange thicknesses and target draft differences between the upper and lower flanges on each side.

$$T_1=t_1\cdot[1-r_4-\{t_2\cdot\Delta r_{OP}+t_3\cdot(\Delta r_{OP}-\Delta r_{DR})/2+t_4\cdot(\Delta r_{OP}+\Delta r_{DR})/2\}/(t_1+t_2+t_3+t_4)] \quad (30)$$

$$T_2=t_2\cdot[1-r_f+\{t_1\cdot\Delta r_{OP}+t_3\cdot(\Delta r_{OP}+\Delta r_{DR})/2+t_4\cdot(\Delta r_{OP}-\Delta r_{DR})/2\}/(t_1+t_2+t_3+t_4)] \quad (31)$$

$$T_3=t_3\cdot[1-r_f-\{t_1\cdot(\Delta r_{OP}-\Delta r_{DR})/2-t_2\cdot(\Delta r_{OP}+\Delta r_{DR})/2-t_4\cdot\Delta r_{DR}\}/(t_1+t_2+t_3+t_4)] \quad (32)$$

$$T_4=t_4\cdot[1-r_f-\{t_1\cdot(\Delta r_{OP}+\Delta r_{DR})/2-t_2\cdot(\Delta r_{OP}-\Delta r_{DR})/2+t_3\cdot\Delta r_{DR}\}/(t_1+t_2+t_3+t_4)] \quad (33)$$

However, in the present invention, because the drafts for flanges at right and left upper and lower locations are set at different values in order to control the center deviation in the universal rolling, there may be an occasion where the resultant thicknesses of the flanges in the four positions differ from each other. Accordingly, with respect to clearances between the rollers in the next pass, it is necessary to set a limit on the difference between the largest clearance and the smallest one, and modify a difference exceeding the limit so that it falls within the limit.

Since it can be regarded that the clearances between rollers at the time of rolling are equal to the thicknesses of flanges coming out therefrom, once the target thickness of each flange is determined as described above, it is possible to calculate, with use of the following formulae, amounts of an axial deviation of upper and lower horizontal rollers relative to each other, a deviation of the roller aperture between right and left vertical rollers, and a deviation of the center position of the clearance between the upper and lower horizontal rollers with respect to the central position of the vertical roller barrels in the universal rolling mill.

$$T_0=(T_1+3T_2+T_3-T_4)/4 \quad (34)$$

$$\Delta C=(T_1-T_2+T_3-T_4)/4 \quad (35)$$

$$\Delta H=\Delta C/\tan\theta \quad (36)$$

$$\Delta T=\{(T_1-T_2)-(T_3-T_4)\}/2 \quad (37)$$

$$\Delta V=T_4-T_2 \quad (38)$$

By using the above-obtained ΔC, ΔH, ΔT, and ΔV as well as the formulae (11)–(19) described in connection with the second aspect of the invention, a setting value for each clearance between rollers can be determined. According to this process, not only the thicknesses of the flanges at right and left upper and lower locations can be made equal, but also the center deviation can be significantly reduced.

In the present invention, its effect can be expected by a single adjustment; however, since a rough rolling is usually performed by a plurality of rollings by reciprocating a material to be rolled, it is preferable to make the adjustment twice or more times in order to attain a better effect of the present invention.

FIG. 12 is a schematic view showing an array of rolling facilities which is preferably employed to carry out the present invention. In FIG. 12, reference numeral 13 designates a breakdown mill; 14, a universal rough rolling mill; 15, an edger rolling mill; 16, a universal finish rolling mill; 17, an instrument for measuring hot dimensions, which is shown as an example arranged on the inlet side of the universal rough rolling mill 14; 18, a calculating device which calculates clearances between rollers in accordance with the above-described process while basing upon the thicknesses of the flanges at four of right and left upper and lower locations, as well as foot lengths of the flanges in some cases, which are measured by the hot dimension-measuring instrument 17; and 19, a device for setting clearances between the rollers of the universal rough rolling mill 14. The results of calculation obtained by the calculating device 18 are inputted into the device 19 and added to preset values of clearances between the rollers for the next pass. The position of each roller is changed based on the thus-obtained values.

In the example shown in FIG. 12, the hot dimension-measuring instrument 17 is installed on the upstream (heating furnace side) of an universal rough rolling mill group composed of the edger rolling mill 15 and the universal rough rolling mill 14, but the location of the measuring instrument 17 may be on the outlet side or downstream of the universal rough rolling mill as long as the thicknesses and foot length of the flanges can be precisely measured after rough rolling. Further, because the present invention is intended to eliminate asymmetry in the clearances between rollers of the universal rolling mill, similar conditions can be applicable to a rolling of a following material. Accordingly, if results of the current rolling are used for the modification of clearances between rollers for the rolling of a following material, it is advantageous for enhancing the dimensional accuracy thereof. As for the allowable range for a modification of the clearances between the rollers, an appropriate value within the range of the relaxation coefficient, which is described earlier, can be used corresponding to the progress of rolling passes.

As for a mechanism shifting the horizontal rollers of a universal rolling mill within a housing thereof, a typical method is disclosed in JP-U-3-24301, and a mechanism as disclosed therein or any similar method may be applicable to the present invention.

BRIEF DESCRIPTION OF THE DRAWINGS

FIG. 2(*b*) is a cross-sectional view showing a bloom; and FIG. 2(*c*) is a cross-sectional view showing a beam blank.

FIG. 4(*b*) is a view showing a cross-sectional shape of a material to be rolled in the course of edger rolling; FIG. 4(*c*) is a view showing a cross-sectional shape of a material to be rolled in the course of finish rolling.

BEST MODE OF THE INVENTION

Embodiment 1

Figure 1A:
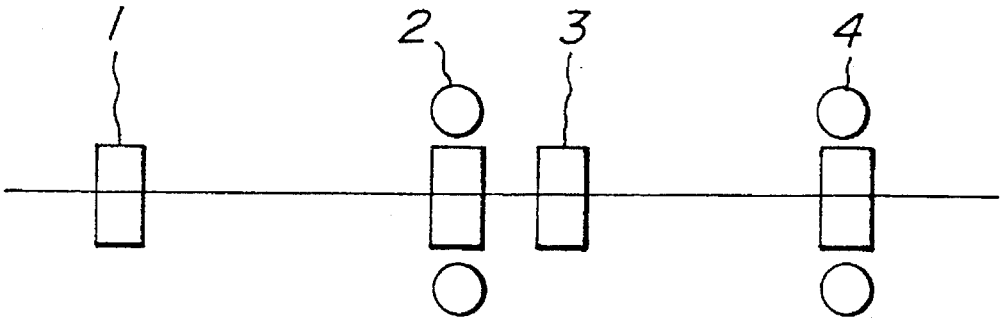
FIGS. 1(*a*) and 1(*b*) are schematic views respectively showing a facility for hot rolling of an H-shaped steel.
Figure 1B:
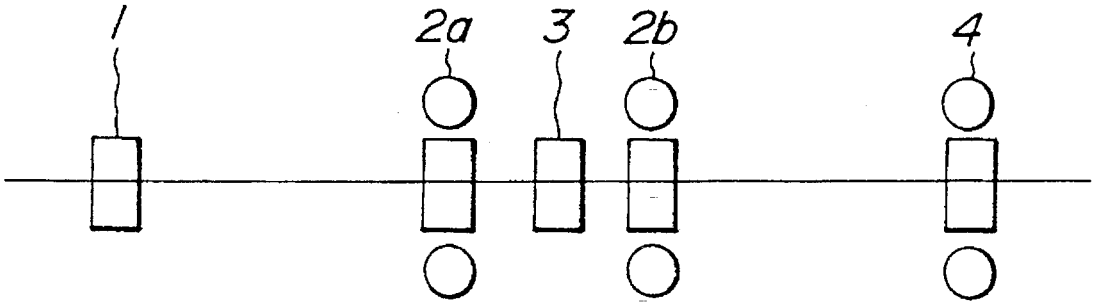
Figure 2A:
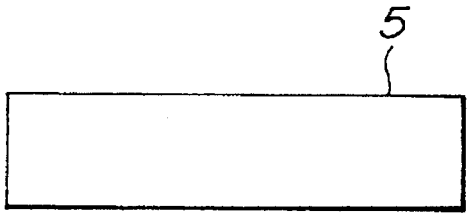
FIG. 2(*a*) is a cross-sectional view showing a slab.
Figure 2B:
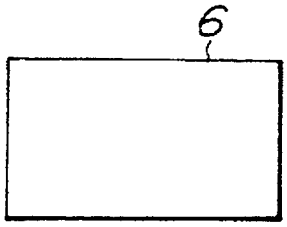
Figure 2C:
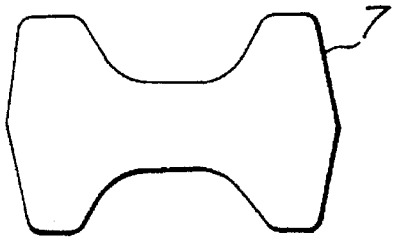
Figure 3A:
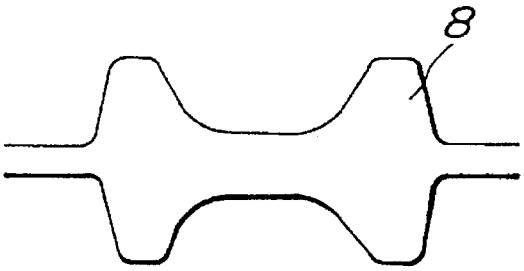
FIGS. 3(*a*) and 3(*b*) are views respectively showing a shape of a caliber for a breakdown rolling mill.
Figure 3B:
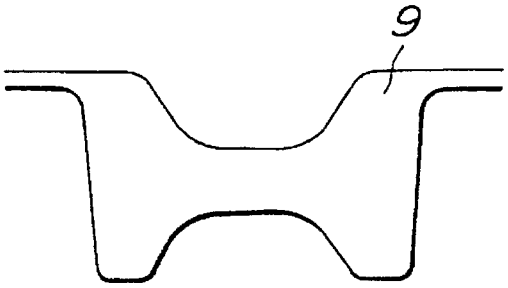
Figure 4A:
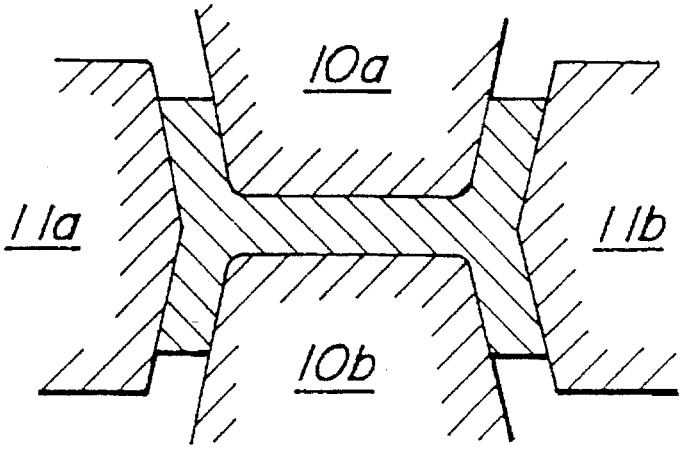
FIG. 4(*a*) is a view showing a cross-sectional shape of a material to be rolled in the course of rough rolling.
Figure 4B:
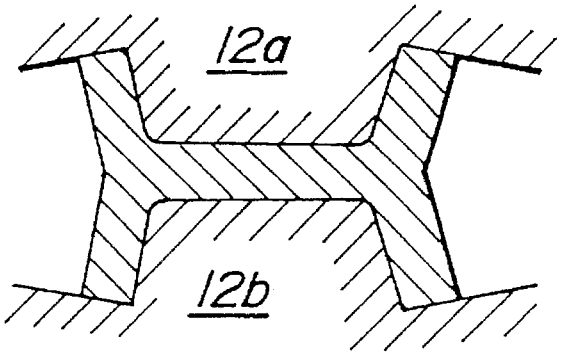
Figure 4C:
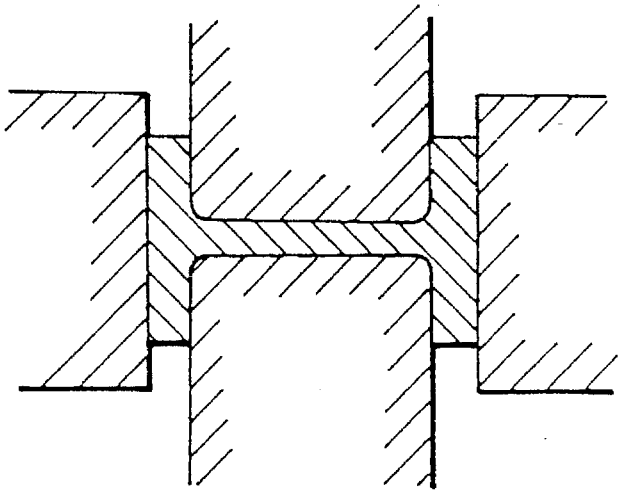
Figure 5:
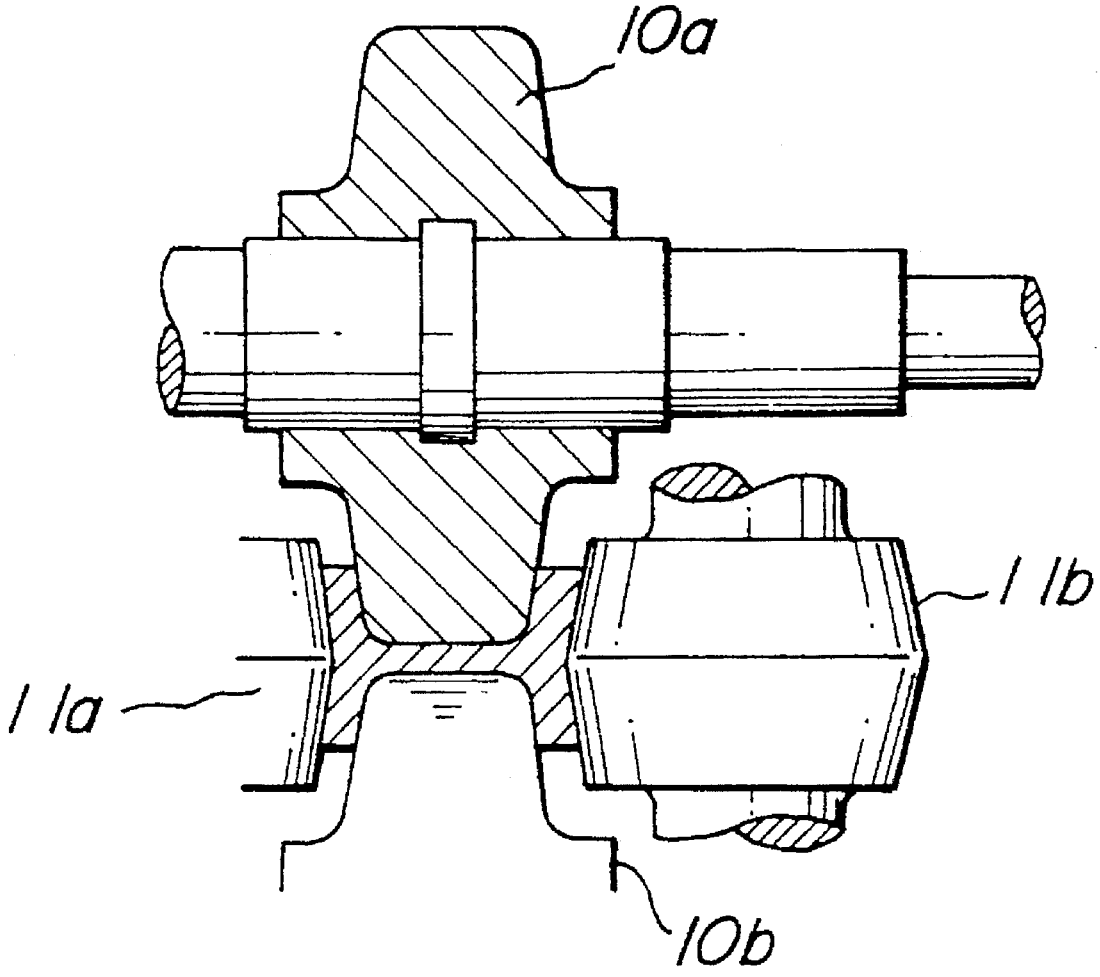
FIG. 5 is a view showing a state of a rough rolling.
Figure 6:
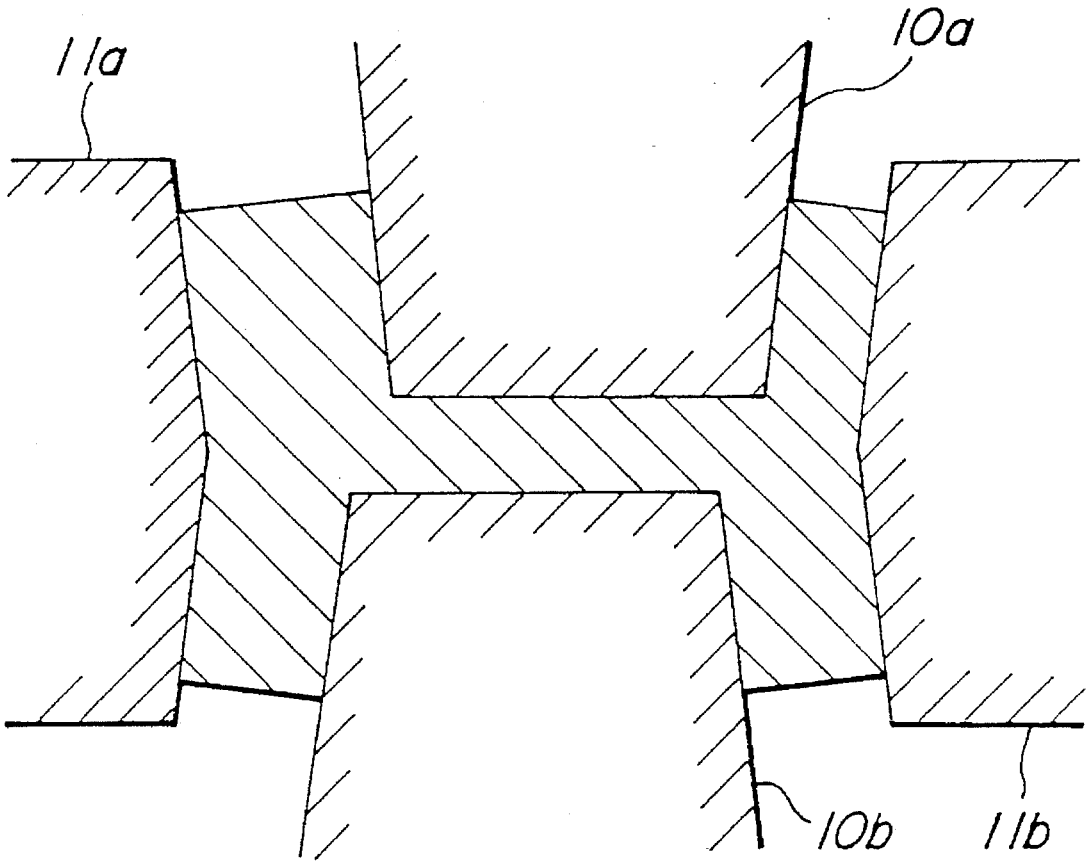
FIG. 6 is a view showing a state wherein roller positions of a universal rolling mill are changed.
Figure 7:
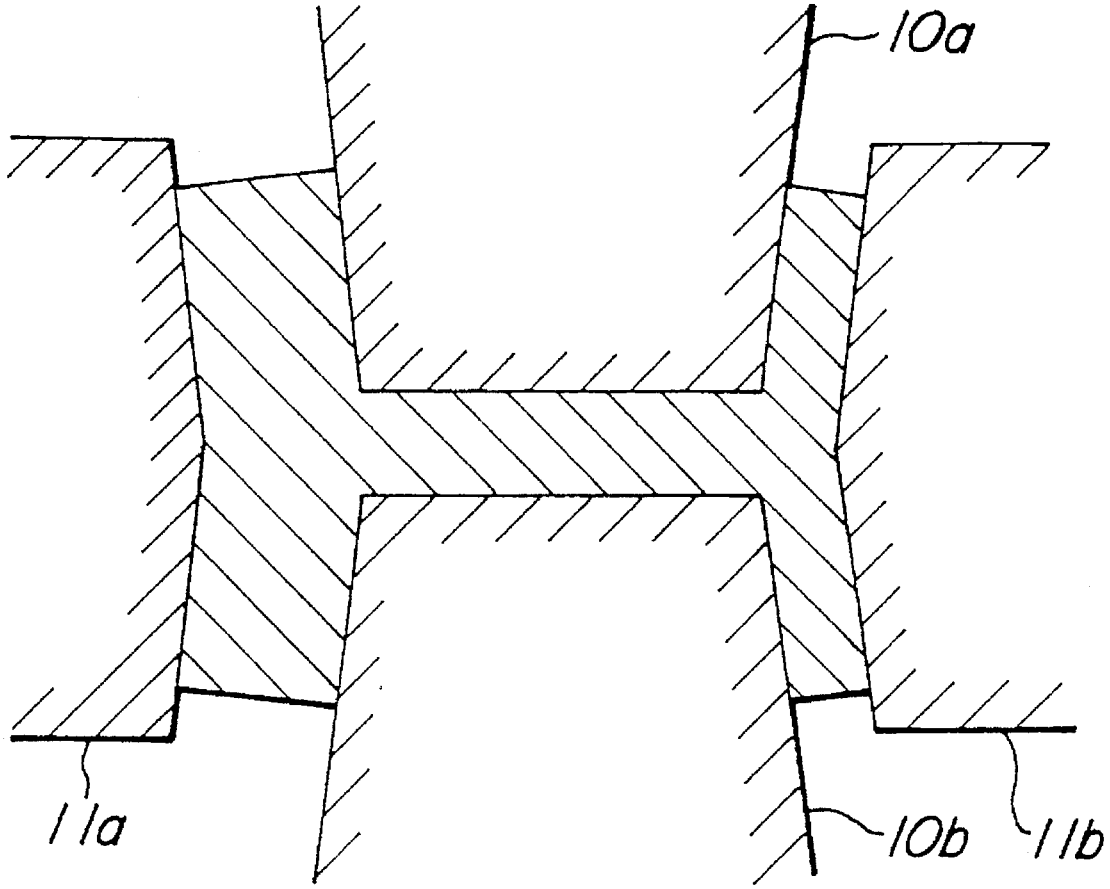
FIG. 7 is a view showing a state wherein roller positions of a universal rolling mill are changed.
Figure 8:
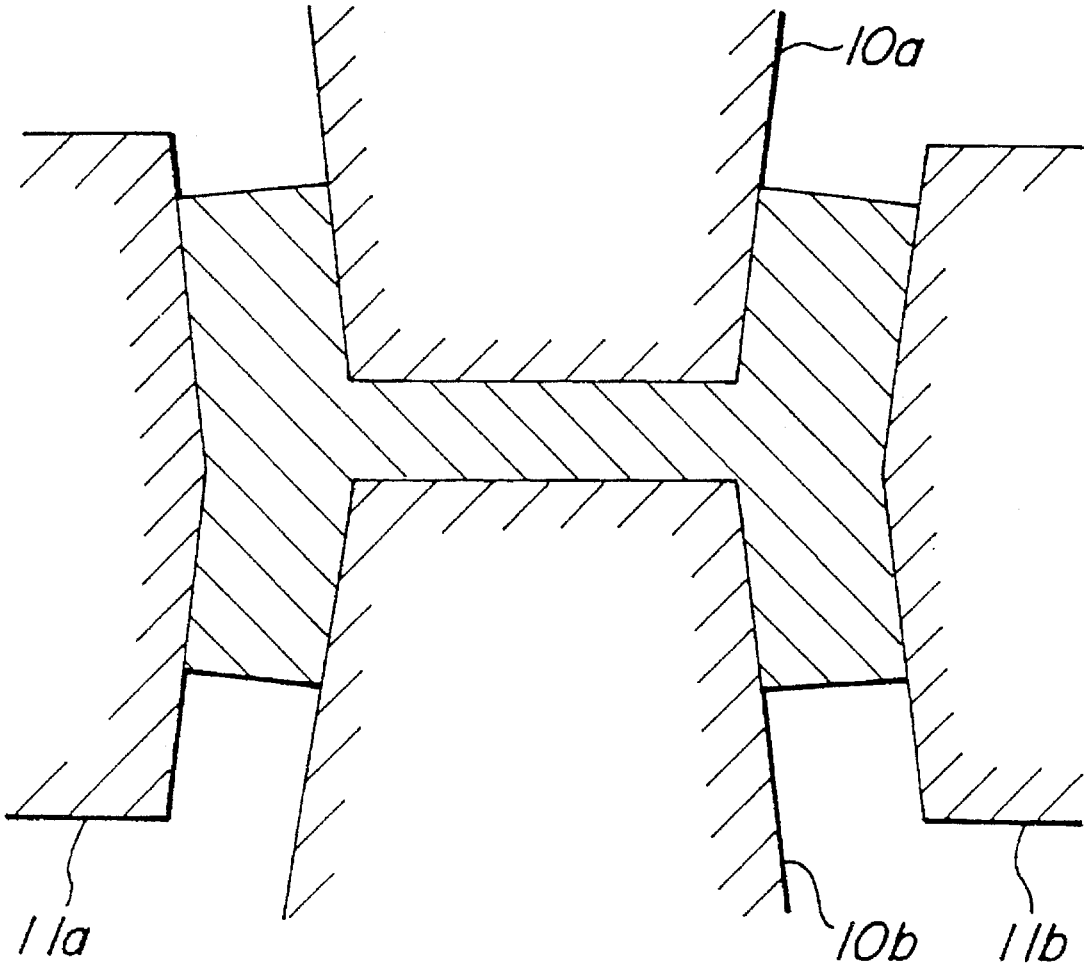
FIG. 8 is a view showing a state wherein roller positions of a universal rolling mill are changed.
Figure 9A:
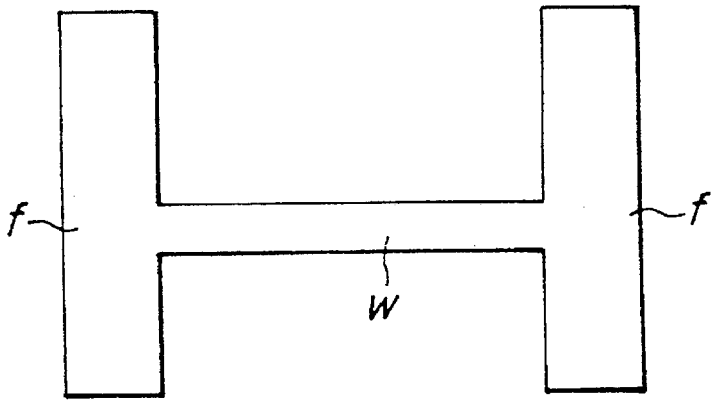
FIGS. 9(*a*) and 9(*b*) are views respectively illustrating a state of center deviation.
Figure 9B:
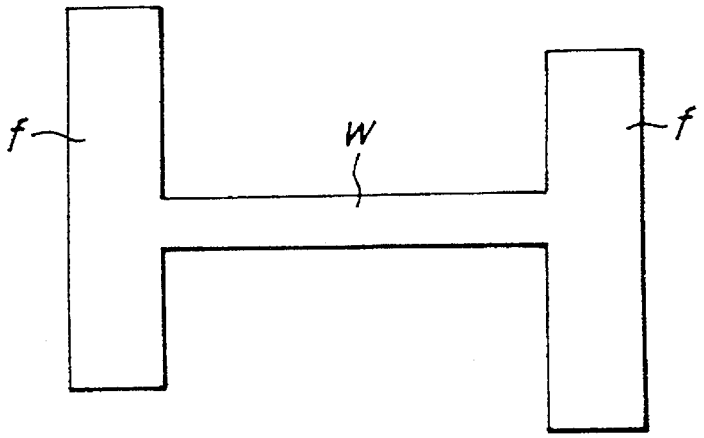
Figure 10:
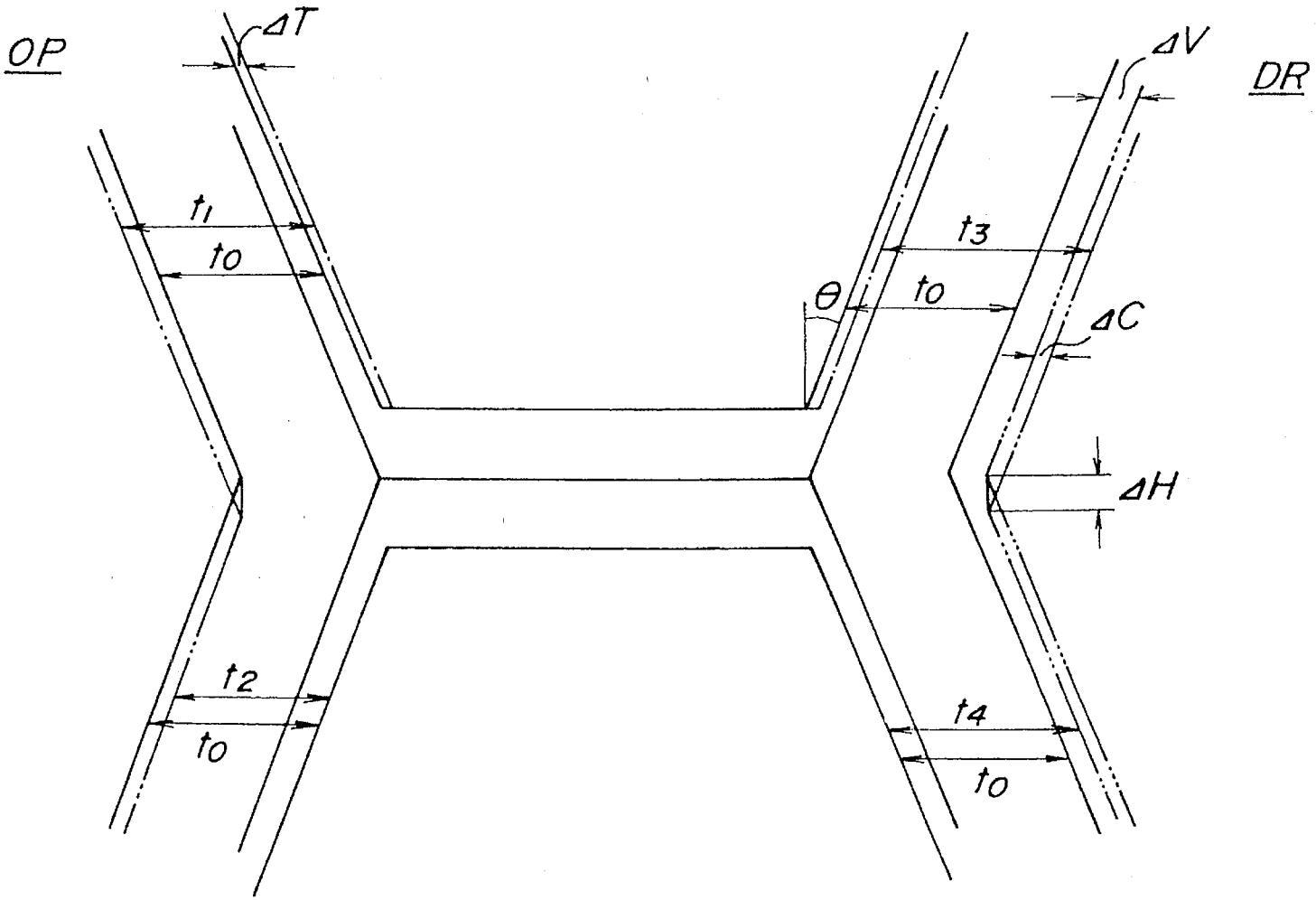
FIG. 10 is a view showing a state wherein an arrangement of roller positions in a universal rolling mill has been changed.
Figure 11:
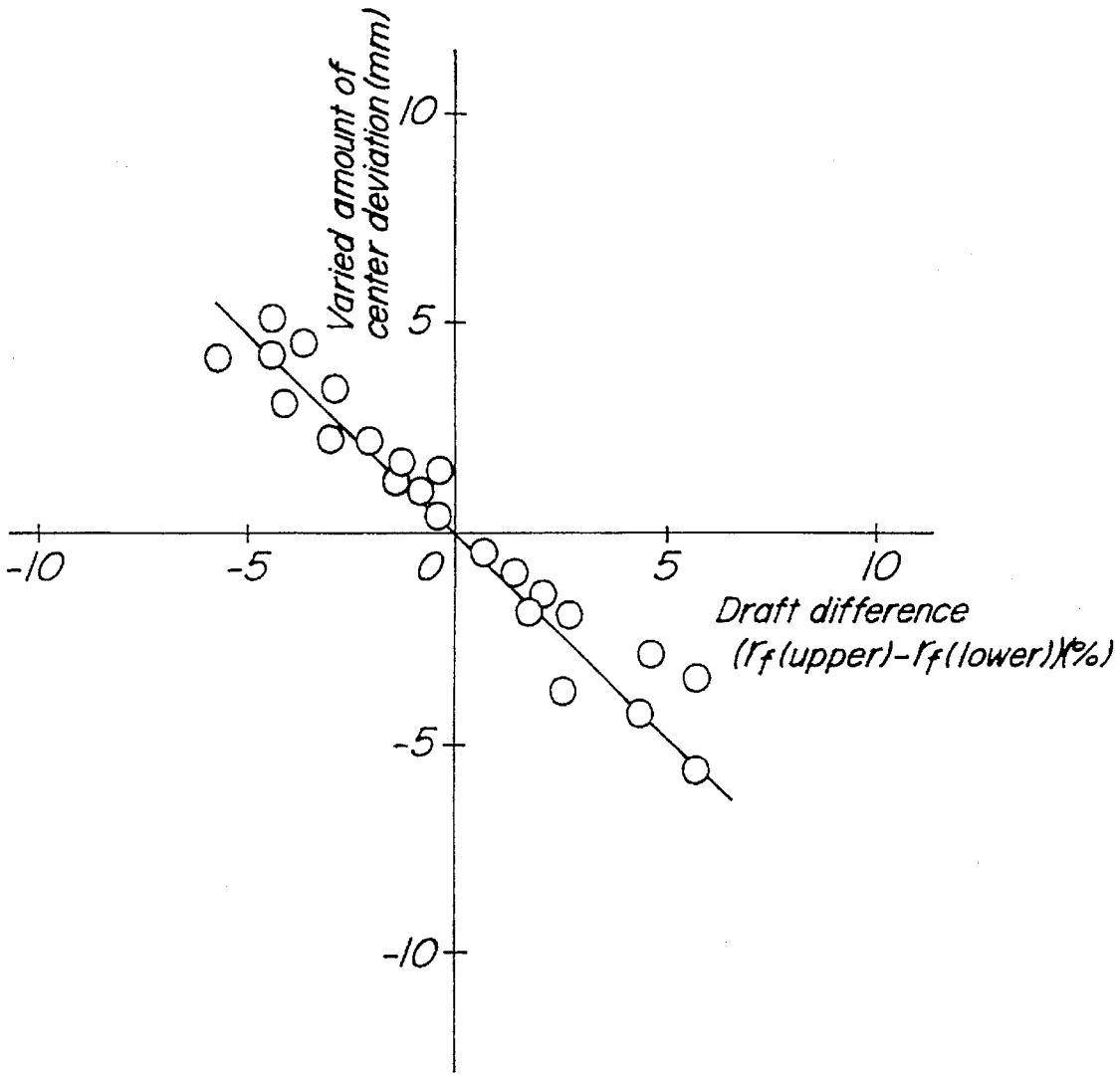
FIG. 11 is a graph showing the relationship between the varied amount of center deviation and the draft difference between the upper and lower flanges.
Figure 12:
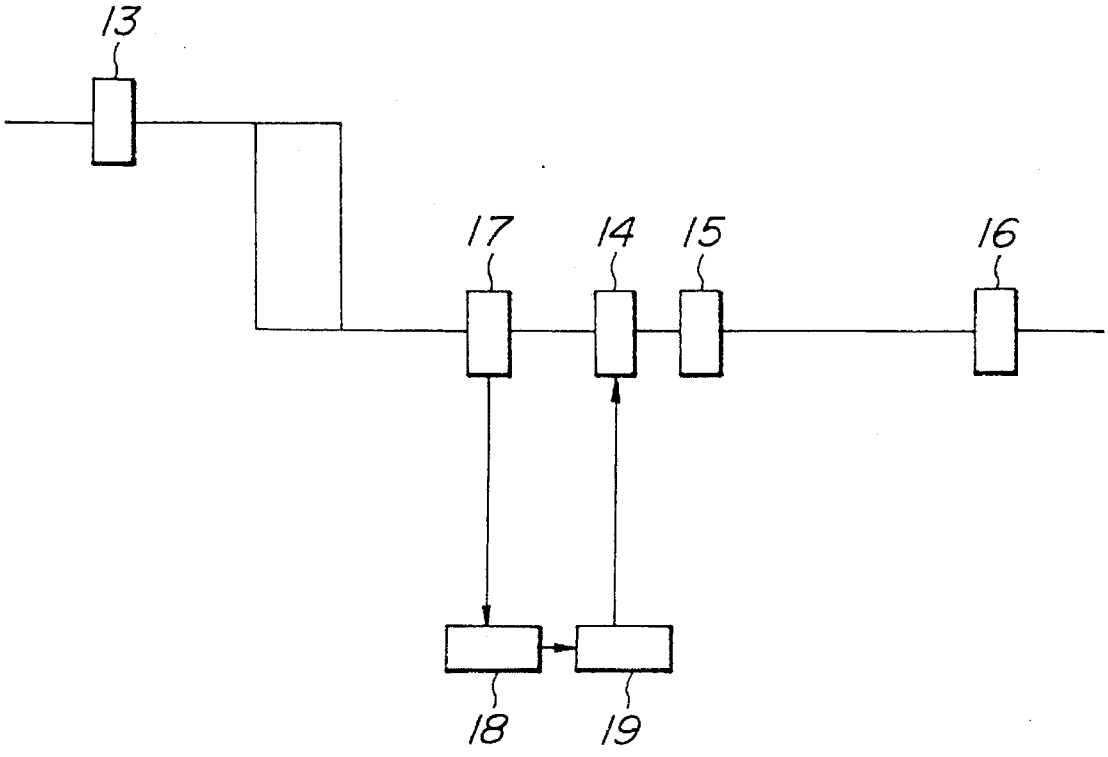
FIG. 12 is a schematic view showing an array of facilities, which is preferably employed to carry out the present invention.

With a beam blank (steel class: SS400) having a web height of 460 mm, a flange width of 400 mm, and a web thickness of 120 mm, which is obtained by a continuous casting, a hot rolling was conducted to form an H-shaped steel whose web height is 600 mm and flange width is 300 mm in nominal dimensions while utilizing the above-mentioned facilities shown in FIG. 12, and the accuracy of flange thicknesses in the course of rolling has been examined.

Here, in the present embodiment, a flange thickness was measured at a longitudinally central position of the rolled material during a pass which was conducted after the material had been rolled long enough to be measured in a rough universal rolling, and then, corrections of the roller positions were carried out in accordance with the second aspect of the invention. The results of the measurement (standard deviation $\sigma$) were compared with those of the conventional method (in the case where no corrections of the roller positions were made). It was 0.28 in the conventional method, and 0.11 in the present invention, in the case of an H-shaped steel having a web height of 600 mm, a flange width of 300 mm, a web thickness of 9 mm, and a flange thickness of 19 mm in section. Also, it was 0.29 in the conventional method, and 0.13 in the present invention, in the case of an H-shaped steel having a web height of 600 mm, a flange width of 300 mm, a web thickness of 12 mm, and a flange thickness of 19 mm in section. Further, it was 0.25 in the conventional method, and 0.12 in the present invention, in the case of an H-shaped steel having a web height of 600 mm, a flange width of 300 mm, a web thickness of 12 mm, and a flange thickness of 25 mm in section. In all cases, it is confirmed that unevenness in the flange thicknesses of the H-shaped steel has been reduced and the dimensional accuracy has been improved, when the rolling was conducted according to the present invention.

Embodiment 2

With a beam blank (steel class: SS400) having a web height of 460 mm, a flange width of 400 mm, and a web thickness of 120 mm, which is obtained by a continuous casting, a hot rolling is conducted to form an H-shaped steel whose web height is 600 mm and flange width is 300 mm in nominal dimensions while utilizing the above-mentioned facilities shown in FIG. 12, and states of center deviations which occurred in the course of rolling have been examined.

Here, in the present embodiment, a thickness and foot length of each flange were measured at a longitudinally central position of the rolled material during a pass which was conducted after the material had been rolled long enough to be measured in a rough universal rolling, and then, corrections of the roller positions were carried out in accordance with the third aspect of the invention. The results of the measurement (standard deviation $\sigma$) were compared with those of the conventional method (in the case where no corrections of the roller positions were made). It was 1.02 in the conventional method, and 0.68 in the present invention, in the case of an H-shaped steel having a web height of 600 mm, a flange width of 300 mm, a web thickness of 9 mm, and a flange thickness of 19 mm in section. Also, it was 1.09 in the conventional method, and 0.52 in the present invention, in the case of an H-shaped steel having a web height of 600 mm, a flange width of 300 mm, a web thickness of 12 mm, and a flange thickness of 19 mm in section. Further, it was 1.10 in the conventional method, and 0.57 in the present invention, in the case of an H-shaped steel having a web height of 600 mm, a flange width of 300 mm, a web thickness of 12 mm, and a flange thickness of 25 mm in section. In all cases, it is confirmed that a center deviation which is inevitable in a hot rolling of an H-shaped steel has been extremely suppressed and the dimensional accuracy has been improved, when the rolling was conducted according to the present invention.

POSSIBILITY OF INDUSTRIAL UTILIZATION

According to the present invention, it is possible to minimize dimensional defects (unevenness of flange thicknesses and center deviation), which are caused by a fluctuation of the roller positions of a universal rolling mill used in a hot rolling of an H-shaped steel.

We claim:

1. A method for detecting setting errors of clearances between rollers of a universal rolling mill during a rolling of an H-shaped steel, wherein a roughly shaped billet subjected to a breakdown rolling and having a web and flanges is formed into a shape steel having H-shaped cross section by passing the roughly shaped billet through an array of rolling facilities for a shape steel constituted by combining a universal rough rolling mill with a universal finish rolling mill, said rough rolling mill comprised of an upper and a lower horizontal roller and a left and a right vertical roller, each of said horizontal rollers arranged along a respective radial axle and a center position, and each of said vertical barrel rollers having a respective aperture and central position, comprising the steps of:

providing an instrument for measuring a thickness of each flange at four locations, said locations comprised of a right and a left and an upper and a lower location of the roughly shaped billet and then using said instrument to measure a hot dimension at said form locations, said instrument arranged in proximity with the rough universal rolling mill using the results of the measurement, to compute an axial deviation of said upper and lower horizontal rollers relative to each other, and a deviation of the apertures of said left and right vertical rollers with respect to each other, and a deviation of the center position of a clearance between the upper and lower horizontal rollers with respect to the central position of the vertical roller barrels.

2. A method for rolling an H-shaped steel, wherein a roughly shaped billet after a breakdown rolling having a web and flanges is formed into a shape steel having H-shaped cross section by passing the roughly shaped billet through an array of rolling facilities for a shape steel constituted by combining a universal rough rolling mill, which is capable of adjusting axial positions of horizontal rollers at every pass, with a universal finish rolling mill, said rough rolling mill comprised of an upper and a lower horizontal roller and a left and a right vertical roller, each of said horizontal rollers arranged along a respective radial axle and a center position, and each of said vertical barrel rollers having a respective aperture and central position, comprising the steps of:

providing an instrument for measuring a thickness of each flange at four locations, said locations comprised of a right and a left and an upper and a lower location of the roughly shaped billet and then using said instrument to measure a hot dimension at said form locations, said instrument arranged in proximity with the rough universal rolling mill, said measurements taken during the rolling of the roughly shaped billet; using the results of the measurement to compute an axial deviation of said upper and lower horizontal rollers relative to each other, and a deviation of the apertures of said left and right vertical rollers with respect to each other, and a deviation of the center position of a clearance between the upper and lower horizontal rollers with respect to the central position of the vertical roller barrels; adjusting the position of each horizontal and vertical roller so that said calculated and respective deviations are corrected to one of a zero value and an allowable value; and then conducting at least one additional pass of rolling on the roughly shaped billet after the adjustment.

3. A method for rolling an H-shaped steel, wherein a universal roughly shaped billet after a breakdown rolling operation in a rough rolling mill has a web and flanges and is formed into a shape steel having an H-shaped cross section by passing the roughly shaped billet through an array of rolling facilities for a shape steel constituted by combining said universal rough rolling mill with a universal finish rolling mill, said rough rolling mill comprised of an upper and a lower horizontal roller on a left and a right vertical roller, each of said horizontal rollers arranged along a respective radial axle and a center position, and each of said vertical barrel rollers having a respective aperture and central position, said rough rolling mill capable of adjusting axial positions of said horizontal rollers after every pass, comprising the steps of:

providing an instrument for measuring a thickness of each flange at four locations, said locations comprised of a right and a left and an upper and a lower location of the roughly shaped billet and a foot length of each flange, and then using said instrument to measure a hot dimension at said four locations and at said foot length, said instrument arranged in proximity with the rough universal rolling mill and used during the rolling of the roughly shaped billet; using the results of the measurements to calculate a center deviation of the right and left flanges in order to obtain a target outlet thickness of each said flange for a next pass; adjusting the position of each horizontal and vertical roller in order to reduce the center deviations to one of a zero value and an allowable value by taking account of a preobtained relationship between a rolling draft difference between the upper and lower flanges and a varied amount of center deviation, wherein an aimed rolling draft of the flanges in a next pass and averages of rolling drafts for said upper and lower flanges on right and left sides should be equal; calculating an axial deviation of upper and lower horizontal rollers relative to each other, a deviation of apertures of said left and right vertical rollers with respect to each other, and a deviation of the center position of a clearance between the upper and lower horizontal rollers with respect to the central position of the vertical roller barrels, basing on the above-obtained target outlet flange thicknesses; adjusting the position of each roller based on the thus-attained deviations; and thus conducting at least one additional pass of rolling on the roughly shaped billet after the adjustment.

* * * * *